US007210563B2

(12) United States Patent
Vroegindeweij

(10) Patent No.: US 7,210,563 B2
(45) Date of Patent: May 1, 2007

(54) GUIDE FOR STAIRLIFT

(75) Inventor: Dennis Vroegindeweij, Hoofddorp (NL)

(73) Assignee: Freelift B.V., Heerhugowaard (NL)

( * ) Notice: Subject to any disclaimer, the term of this patent is extended or adjusted under 35 U.S.C. 154(b) by 0 days.

(21) Appl. No.: 10/510,811

(22) PCT Filed: Apr. 14, 2003

(86) PCT No.: PCT/NL03/00282

§ 371 (c)(1),
(2), (4) Date: May 16, 2005

(87) PCT Pub. No.: WO03/086936

PCT Pub. Date: Oct. 23, 2003

(65) Prior Publication Data

US 2005/0224294 A1 Oct. 13, 2005

(30) Foreign Application Priority Data

Apr. 12, 2002 (NL) ..... 1020372

(51) Int. Cl.
*B66B 9/08* (2006.01)

(52) U.S. Cl. ..... 187/201; 187/245; 198/321

(58) Field of Classification Search ..... 187/201, 187/245; 198/321
See application file for complete search history.

(56) References Cited

U.S. PATENT DOCUMENTS

| | | | | |
|---|---|---|---|---|
| 5,230,405 | A * | 7/1993 | Bartelt | 187/201 |
| 5,967,265 | A * | 10/1999 | Bruno et al. | 187/201 |
| 6,761,250 | B1 * | 7/2004 | Szentistvany et al. | 187/201 |
| 2002/0007999 | A1 | 1/2002 | Grass | |
| 2002/0074188 | A1 * | 6/2002 | Lorton | 187/201 |
| 2003/0051949 | A1 * | 3/2003 | Chen | 187/289 |
| 2005/0224294 | A1 * | 10/2005 | Vroegindeweij | 187/201 |

FOREIGN PATENT DOCUMENTS

| | | | |
|---|---|---|---|
| DE | 31 03 162 | A1 | 8/1982 |
| FR | 2 699 907 | A | 7/1997 |
| GB | 2216869 | A * | 10/1989 |

* cited by examiner

*Primary Examiner*—Patrick Mackey
*Assistant Examiner*—Terrell Matthews
(74) *Attorney, Agent, or Firm*—Harness, Dickey & Pierce, P.L.C.

(57) ABSTRACT

The invention relates to a guide for a lift along a staircase, comprising an elongate profile with at least one edge thereon, which edge extends along a considerable part of the length of the profile, wherein the edge of the profile is serrated and forms a gear rack for engagement thereon by a drive of the lift.

18 Claims, 3 Drawing Sheets

GUIDE FOR STAIRLIFT

The present invention relates to a guide for a lift along a staircase, and in addition to a system with such a guide and a lift along a staircase.

Diverse guides for stairlifts are known in the art. A linear guide for systems along straight staircases is thus known from U.S. Pat. No. 5,230,405. The guide is here a C-shaped profile which is disposed along a staircase with the open side upward. A gear rack is mounted separately on top of the C-shaped profile, for instance by welding the gear rack onto the profile.

It is noted that diverse other types of guide for stairlifts are known. The guides can thus be curved where the staircase has bends etc. in order to follow the path of the staircase. Guides with curves are usually produced from closed profiles, preferably profiles of circular cross-section, which are bent into the desired form. These profiles are therefore closed. After bending into the desired form, a gear rack can be arranged on such a profile, also for instance by welding thereof.

The above described known art has a number of drawbacks. The most notable drawback for all known guides is that use must be made in each case of a separate gear rack which, after forming or bending etc. of the guide, must be arranged thereon. Such a separate component as the gear rack entails high costs and, because after forming, bending etc. of the guide, additional operations are still required to arrange the gear rack, the throughput time during production is relatively long. Particularly in the case of guides with curves, the arrangement of a gear rack thereon is still a considerable task, wherein errors can still occur if the gear rack is unintentionally arranged with incorrect orientation on the profile of the guide. Material losses hereby increase and arranging of the gear rack can only be entrusted to highly automated production facilities and/or highly qualified welders.

Known from the French patent application 2,699,907 is a guide formed from flat plate steel. Slotted holes are arranged therein, whereafter the plate steel is bent or folded to produce a substantially C-shaped profile. In the thus obtained design a gear rack is provided on the underside of the C-shaped profile by the succession of slotted holes.

These slotted holes then necessarily extend through two bends of the folded plate material. This creates the problem that narrow strips of material must absorb all forces exerted on the guide when a carriage, for instance with a chair thereon, advances along the guide.

Such a profile is moreover unsuitable for the use, in side view of a gear rack on a guide, with standardized toothed wheels, such as for instance defined in international standards. NEN-1629 is mentioned by way of example.

Another very serious drawback is that safety is at risk. The gear rack formed in accordance with this French patent application is situated on the underside of the guide, and in particular the C-shaped profile. There is therefore the real danger that articles of clothing or limbs can be caught between the thus formed gear rack and a carriage advancing therealong and having thereon for instance a chair of the whole lift installation.

A gear rack furthermore usually requires lubrication, and because the gear rack according to the known art is embodied in sight, which is also aesthetically unattractive, dirtying of clothing can also occur because the gear rack is embodied not only in sight but also within reach of clothing and of users. The position of the thus formed gear rack therefore has drawbacks in respect of clothing and limbs being caught or dirtied in the use of a carriage advancing therealong as component of the lift. It is moreover the case that the gear rack designed according to the known art can also have sharp edges, even if this is remedied or not intended during the production process, because of the high level of wear which the toothed wheel causes, or can at least cause, when engaging on the gear rack as drive for a carriage advancing along the guide. Such sharp edges of the gear rack once again represent a safety hazard. In addition, the forming in the plate material of the slotted holes which must eventually form the gear rack is a very precise matter so as to obtain a smooth running. An evolvent toothing is almost impossible to realize here. Vibrations therefore occur in a carriage advancing along the guide, whereby the user comfort will be exceptionally low.

The invention has for its object to obviate or at least alleviate the above stated problems of the known art, for which purpose a guide according to the present invention has the features of claim 1. The problems of the prior art are obviated or at least alleviated in a guide according to the invention in that the serration on the side-edge can serve as gear rack, whereby the gear rack has become an integral component of the guide itself. The costs and the throughput time etc. are thereby reduced. All problems relating to safety can furthermore be resolved when a guide according to the present invention is used. The gear rack formed on an side-edge can be concealed from the view and the reach of users. The risk that articles of clothing or limbs or fingers etc. can become caught between a drive toothed wheel and the gear rack are then minimized. Furthermore, the compliance of the form of separate teeth with for instance the ISO-1328 norm and the use of standardized toothed wheels, for instance in accordance with NEN-1629, is considerably simplified. Sharp edges which can occur anyway through wear are not a danger to users or people in the unlikely event they fall down the stairs along the guide. Such a reduced wear can be realized substantially by designing the separate teeth of the gear rack on the side-edge of the guide so as to provide an evolvent toothing. Wear will thereby be minimized. It will furthermore be possible hereby to realize a smooth running, whereby vibrations can be avoided.

Such a guide can be formed from elongate flat plate material that is bent. This is a particularly favourable and elegant embodiment in its simplicity. The plate material is preferably bent after the side-edge has been serrated, and the gear rack is thereby formed. This is because of the accessibility of the side-edge with the tools required to arrange the serration. The profile can further be formed from the plate material with roller—forming, which is a particularly efficient manner of forming three-dimensional profiles from two-dimensional flat plate material in a single continuous process.

The serrated side-edge can be punched on the side-edge of the profile. Punching is a particularly favourable manner of arranging the serration and thereby forming the gear rack and, in contrast to for instance machining methods, can be realized simultaneously along considerable lengths.

The guide can further comprise an additional profile. Such an additional profile can be used for diverse purposes, such as robustness, safety etc. The additional profile can thus comprise a flange which extends at a distance along the gear rack. A protection for the gear rack can thus be realized which moreover has the advantage that the gear rack is at least partially concealed from view. Additionally or alternatively, the additional profile can be open, which has the advantage that an open additional profile can provide an extra engagement for the lift which must move along the guide. A support wheel or follower as defined in claim 9 can thus be placed in the interior of the open additional profile in order to increase the support for the lift, and thereby improve the stability of the lift. Similar considerations apply for the profile with the serrated side-edge as defined in claims 11 and 12.

As already noted, the invention is not limited to straight guides but the guides according to the invention can also define paths for the lift which comprise curves. The invention will nevertheless be further elucidated hereinbelow with reference to an embodiment which is based, in non-limitative manner, on straight guides, and is shown in the drawings, in which.

Figure 1:
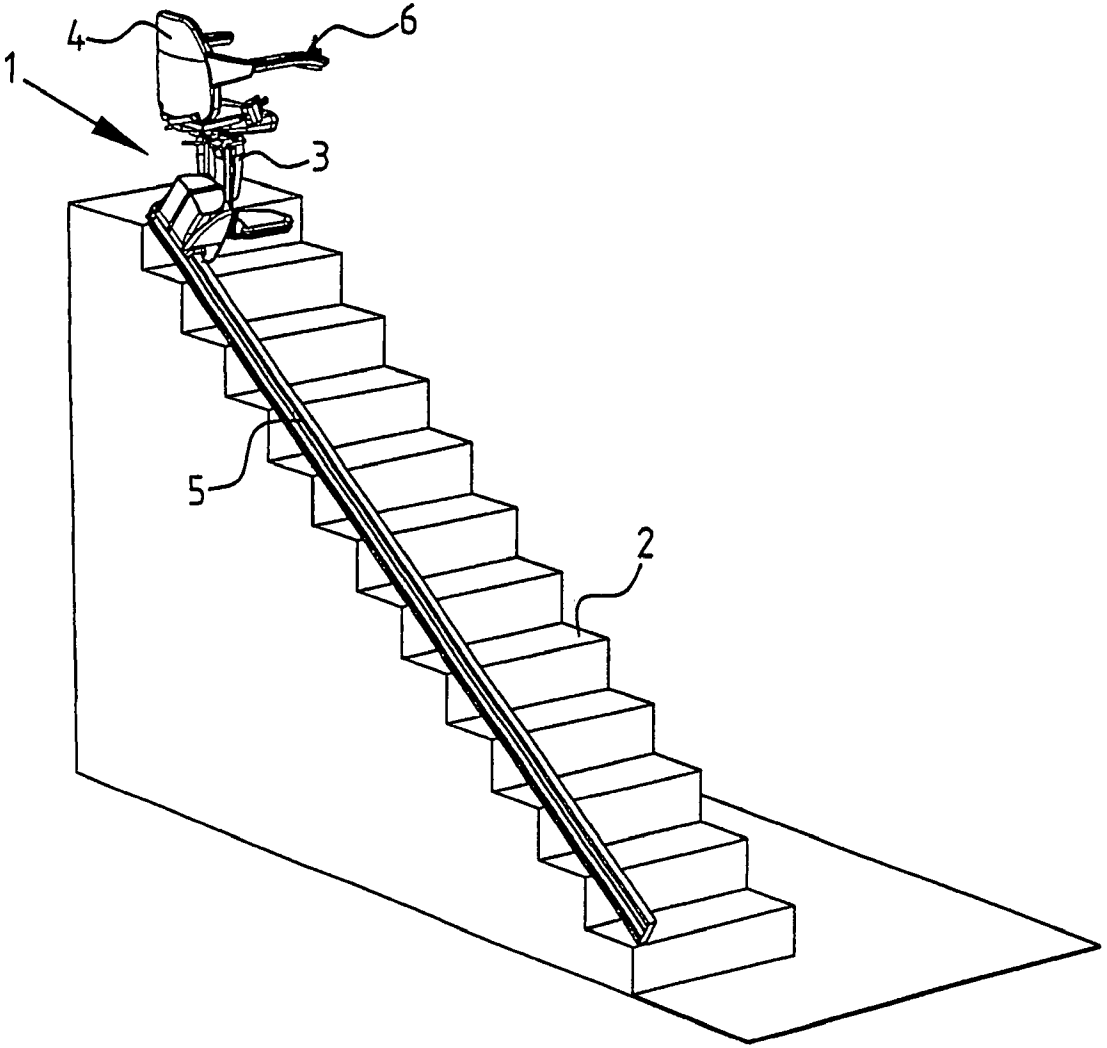
FIG. 1 shows a schematic view of an embodiment of the present invention in use with a straight guide shown only by way of example.

FIG. 1 shows a system 1 according to the present invention. System 1 is disposed along a staircase 2 and comprises a lift 3 on which is mounted a chair 4, and a guide 5 according to the present invention.

Using system 1 it is possible for a user to sit in the chair and be transported from the one floor to another in a building by actuating control handle 6, which is comparable to a joystick. A user does not then have to climb the staircase 2 or walk downstairs.

Figure 2:
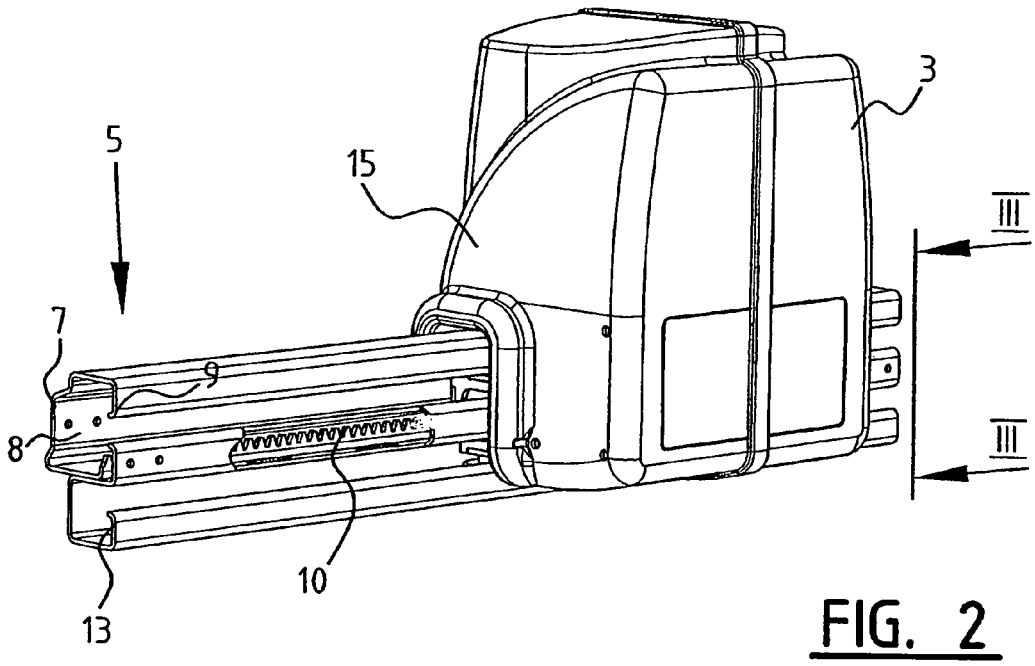
FIG. 2 shows a perspective, partly cut-away rear view of parts of the system shown in FIG. 1.
Figure 3:
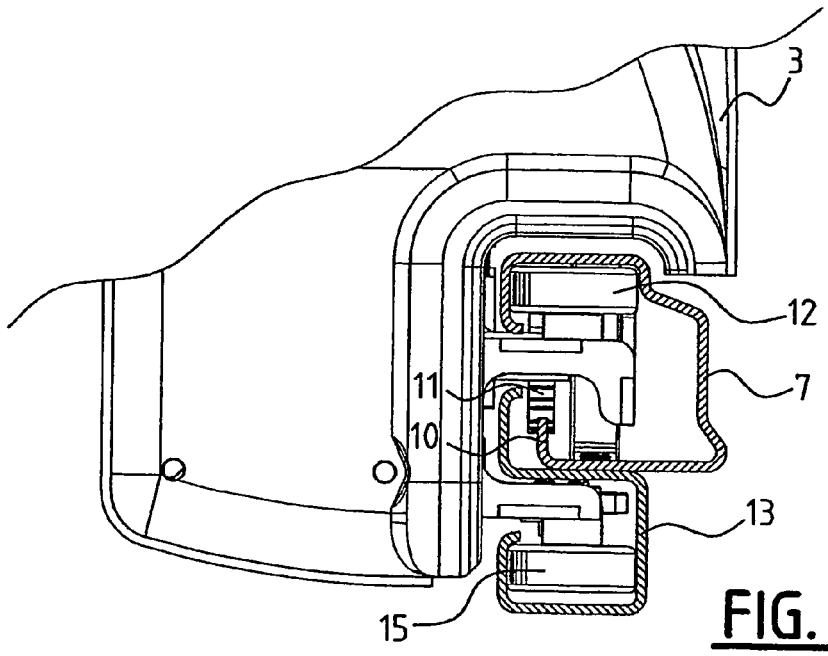
FIG. 3 shows a view in cross-section along the plane designated III—III in FIG. 2.

As shown in FIG. 2, the guide comprises an open profile 7 with an opening 8 in the longitudinal direction thereof. Along opening 8 the open profile has an unprocessed or slightly bent side-edge 9, and on the side of the opening opposite side-edge 9 the open profile 7 has a serrated or toothed side-edge 10, as shown in the cut-away portion of FIG. 2. The toothing or serration on side-edge 10 forms a gear rack which, as shown in FIG. 3, is engaged by a toothed wheel 11. Toothed wheel 11 forms part of the drive of lift 3, as do other components (not shown) such as a motor etc.

The open profile 7 can be manufactured in various ways. One possible embodiment is that an elongate, flat plate material is used that is bent. The plate material is preferably bent after the side-edge thereof, which becomes the side-edge 10 after bending of the plate material, is serrated or provided with toothing, to thus form the gear rack of open profile 7 after bending thereof.

Bending can take place by applying roller forming of the plate material. The plate material herein passes through a number of rollers or wheels disposed at angles relative to each other in order to thus bend the plate material.

The side-edge is preferably first serrated or provided with toothing and then bent into the embodiment shown here, since the accessibility of side-edge 10 after the bending of the plate material is then too limited for arranging of the toothing or serration.

It is also noted that at the side-edge 9 of open profile 7 space is provided in this open profile 7 for a follower 12, which is used primarily to support the lift 3 to prevent rotation thereof round open profile 7.

As shown further in FIG. 2 and 3, guide 5 further comprises an additional profile 13 which, just as open profile 7, is open and can be produced in the same manner, with the exception of the toothing or serration on the side-edge 10 of open profile 7. Additional profile 13 comprises a flange 14 which extends in front of and at a distance from the side-edge 10 of open profile 7 forming a gear rack. The gear rack is hereby protected and shielded as safety against accidents where a user could be caught between toothed wheel 11 and the gear rack on side-edge 10. This is also intended in other ways, for instance by the form of the housing 15 of lift 3, which housing 15 fits closely onto the external forms of guide 5. Insofar as necessary the flange 14 otherwise conceals from view the serration or toothing on side-edge 10 with which a gear rack is formed, for instance when guide 5 has to be placed some distance from the wall.

As already noted above, the additional profile 13 is also open. It is thereby possible for an additional follower 15 to be arranged therein so as to increase the stability of lift 3. The assembly of the open profile 7 with the additional open profile 13 also brings about an increased rigidity compared to an embodiment without additional profile 13 and with the embodiment shown in FIG. 3, wherein the additional profile 13 is also open, just as open profile 7, and the option of the above described extra follower is hereby provided in order to increase the stability.

Figure 4:
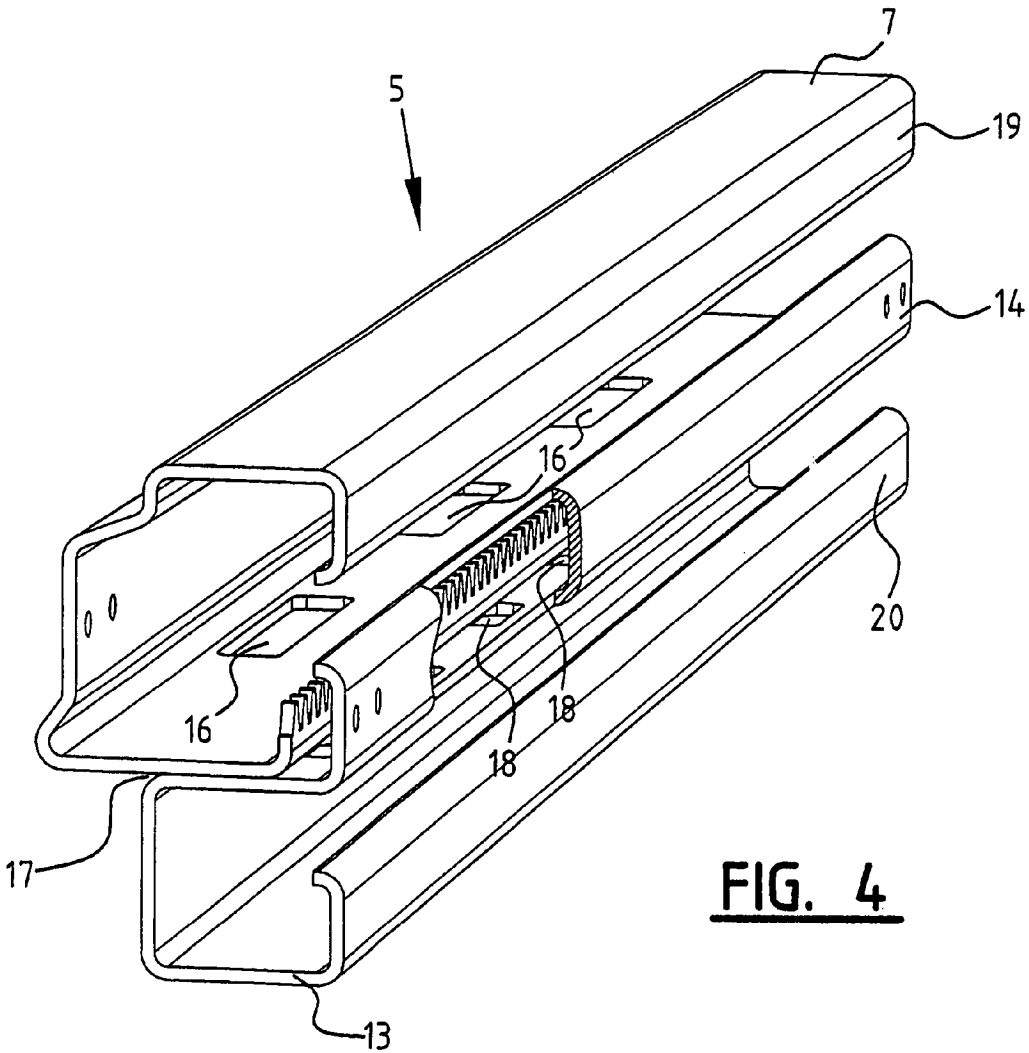
FIG. 4 shows a partly cut-away perspective view of only a guide according to the present invention.

FIG. 4 shows a segment of guide 5 in perspective view. Clearly discernible herein are holes 16 which can be used to arrange assist means for assembly such as mounting brackets (not shown). It is possible to mutually connect profile 7 and additional profile 13 along side-edge 17, for instance by welding. In order to optimize this connection it is also possible to weld through holes 18 in the upper side of additional profile 13. It is noted that for an attractive appearance the flange 14 preferably lies in one vertical plane together with the part 19 lying on the upper and front side of the open profile 7 and the part 20 lying on the lower and front side of additional profile 13.

In the foregoing and in the drawing there is described and shown in detail an embodiment of the invention to which the invention is not however limited, since this is defined in the appended claims and it is these definitions which are decisive in determining the scope of protection for the invention, and not the explicitly described and shown embodiments thereof. It is thus possible to apply diverse additions, alternatives and modifications in the embodiment explicitly discussed herein without departing from the scope of protection defined in the claims. Although it is better for the rigidity and the strength of the guide to arrange the additional profile, it is possible to omit it. A flange for protection and shielding does however appear to be very desirable, if not necessary. In an embodiment which is not shown or described the guide can also have a non-linear form and comprise bends or curves. The toothing or serration can also be arranged on the side-edge of the open profile lying above the opening in order to form a gear rack. The profile with the serrated side-edge can be a closed profile, for instance bent-round plate material, of which at least one side-edge with the toothing or serration protrudes radially or otherwise for engagement by a drive.

The invention claimed is:

1. Guide for a lift along a staircase, comprising:

an elongate profile having a pair of opposed major surfaces and a side surface that extends between the opposed major surfaces, wherein the side surface of the profile is serrated to form a gear rack that extends from the side surface, wherein the gear rack is engageable with a drive of the lift, and wherein the profile and the gear rack are of a unitary, one-piece construction.

2. Guide as claimed in claim 1, wherein the profile is formed from elongate flat plate material that is bent.

3. Guide as claimed in claim 2, wherein the plate material is bent after the side surface has been serrated.

4. Guide as claimed in claim 2, wherein the profile is formed from the plate material with roller-forming.

5. Guide as claimed in claim 1, wherein the serrated side surface is punched on the side surface of the profile.

6. Guide as claimed in claim 1, wherein during use of the guide the side surface is oriented parallel to a wall of a stairwell in which the guide is then placed, with the gear rack out of sight and beyond harmful and obstructing reach.

7. Guide as claimed in claim 1, wherein the gear rack is formed in accordance with a standard norm.

8. Guide as claimed in claim 1, wherein the gear rack comprises an evolvent toothing.

9. Guide as claimed in claim 1, further comprising an additional profile.

10. Guide as claimed in claim 9, wherein the additional profile comprises a flange which extends at a distance along the gear rack.

11. Guide as claimed in claim 9, wherein the additional profile is open with an opening therein.

12. Guide as claimed in claim 11, wherein the opening and the form of the additional profile are designed for engaging therethrough and receiving therein of a support wheel of the lift.

13. Guide as claimed in claim 1, which defines a path comprising at least one curve for the lift.

14. Guide as claimed in claim 1, wherein the profile with the serrated side surface is open along a considerable part of the length thereof and the serrated side surface extends along the opening.

15. Guide as claimed in claim 14, wherein the opening and the form of the profile are designed for engaging therethrough and receiving therein of a support wheel of the lift.

16. System comprising a guide as claimed in claim 1, and a lift along a staircase.

17. Guide as claimed in claim 3, wherein the profile is formed from the plate material with roller-forming.

18. Guide as claimed in claim 10, wherein the additional profile is open with an opening therein.

* * * * *